US008928711B2

(12) United States Patent
Caporossi et al.

(10) Patent No.: US 8,928,711 B2
(45) **Date of Patent: *Jan. 6, 2015**

(54) APPARATUS, SYSTEM AND METHOD FOR AUTOMATED DETECTION OF SIGNALING IN A PRINT HEAD

(71) Applicants: James Caporossi, Highland Park, NJ (US); Scott Margo, Colonia, NJ (US)

(72) Inventors: James Caporossi, Highland Park, NJ (US); Scott Margo, Colonia, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/254,304

(22) Filed: Apr. 16, 2014

(65) Prior Publication Data

US 2014/0240436 A1 Aug. 28, 2014

Related U.S. Application Data

(63) Continuation of application No. 13/625,327, filed on Sep. 24, 2012, now Pat. No. 8,736,649.

(60) Provisional application No. 61/537,921, filed on Sep. 22, 2011.

(51) Int. Cl.
*B41J 2/355* (2006.01)
*B41J 2/335* (2006.01)

(52) U.S. Cl.
CPC ..... *B41J 2/3555* (2013.01); *B41J 2/3352* (2013.01); *B41J 2/355* (2013.01)
USPC ..... 347/211

(58) Field of Classification Search
USPC ..... 347/180, 181, 182, 185, 188, 196, 211; 400/120.05, 120.06, 120.09, 120.15
See application file for complete search history.

(56) References Cited

U.S. PATENT DOCUMENTS 8,736,649 B2 * 5/2014 Caporossi et al. ..... 347/211

* cited by examiner

*Primary Examiner* — Huan Tran
(74) *Attorney, Agent, or Firm* — Barnes & Thornburg LLP; Thomas J. McWilliams; Edward F. Behm, Jr.

(57) ABSTRACT

The present invention is and includes an apparatus, system and method for providing an automated detection of thermal history control signal scheme and an automated switching circuit to select a converter circuit that changes one type of thermal history control signals from a thermal printer to another type for receipt by the driver ICs on a thermal printhead.

8 Claims, 7 Drawing Sheets

APPARATUS, SYSTEM AND METHOD FOR AUTOMATED DETECTION OF SIGNALING IN A PRINT HEAD

CROSS-REFERENCE TO RELATED APPLICATION

This application is a continuation of U.S. patent application Ser. No. 13/625,327, filed Sep. 24, 2012, which claims the benefit of priority to U.S. Provisional Patent Application No. 61/438,414, filed Feb. 1, 2011, the entirety of which is incorporated herein by reference.

BACKGROUND OF THE INVENTION

1. Field of the Invention

The present invention is directed to a signal conversion circuit and, more particularly, to an apparatus, system and method for automatically detecting and converting thermal printhead dot history control signals from one type to a different type.

2. Description of the Background

Typical printers in the current art may be classified into four major categories: dot matrix printers, inkjet printers, laser printers, and thermal sublimation (or thermal transfer) printers. Thermal printers have become increasingly popular due to their economical performance. A thermal printer uses a thermal print head (TPH) to heat ribbons or paper containing dyes. The dyes of the heated ribbon are transferred onto the object to be printed, such as paper, or change the dye in the paper dark or to a particular color.

More specifically, a TPH may print on an output medium by, for example, transferring pigment from a donor sheet to the output medium or by initiating a color-forming reaction in the output medium. The output medium may be a porous receiver receptive to the transferred pigment, or a paper coated with the color-forming chemistry, for example. Each of the TPHs, when activated, may form color on the medium passing underneath the TPH, creating a spot having a particular density. Regions with larger or denser spots are perceived as darker than regions with smaller or less dense spots. Digital images are rendered as two-dimensional arrays of very small and closely-spaced spots.

Furthermore, TPHs may be very expensive, and may be unique to particular manufacturer and printer model. Various TPH manufacturers may produce TPHs capable of using dot history control (DHC) for which specific driver integrated circuits (ICs) are used to control signal timing from the printer to the TPH using a particular and specific set of timing signals. By producing THPs with unique ICs using these particular and specific set of timing signals, THP manufacturers severely limit the availability of constituent parts used to make a TPH to be used with a particular printer.

Thus, the need exists in the current art for an apparatus, system and method to allow for the interchangeability of comparable integrated circuit drivers for thermal print heads, and related apparatuses, systems and methods to solve the above-mentioned problems.

BRIEF DESCRIPTION OF THE DRAWINGS

Understanding of the disclosure will be facilitated by consideration of the following detailed description of the embodiments, taken in conjunction with the accompanying drawings, in which like numerals refer to like parts and in which.

DETAILED DESCRIPTION OF THE INVENTION

It is to be understood that the figures and descriptions of the present invention have been simplified to illustrate elements that are relevant for a clear understanding of the present invention, while eliminating, for the purposes of clarity, many other elements found in typical printing apparatuses, systems and methods. Those of ordinary skill in the art will recognize that other elements are desirable and/or required in order to implement the present invention. However, because such elements are well known in the art, and because they do not facilitate a better understanding of the present invention, a discussion of such elements is not provided herein.

The present invention provides a conversion circuit to allow a printer controller to send a different set of control signals for Dot History Control (DHC) to a printhead and its ICs than the IC is designed to receive and a detection circuit to choose the type of signaling. Common elements of a DHC system in the current art are discussed hereinbelow with respect to FIG. 1, and typical TPH printing using such a system is discussed hereinbelow with respect to FIG. 2. For example, the present invention allows a printer controller programmed to send seven (7) DHC controller signals to be interfaced with an IC designed to receive only five (5) DHC controller signals, such as using the conversion circuit of the previous art as described in U.S. Patent Application Ser. 61/438,414.

By way of background, in a conventional TPH, a plurality of ICs may be provided on a ceramic wafer along with the necessary heat elements. The purpose of the ICs may be to switch the heat elements on and off. ICs may, for example, be provided with: a shift register that stores data consisting of as many bits as the resistive elements that the driver device needs to drive; a plurality of logic gates that feed the data of the individual bits of a shift register to a transistor; a plurality of transistors that drive the resistive elements; and output terminals connected to the resistive elements or heaters.

Figure 1:
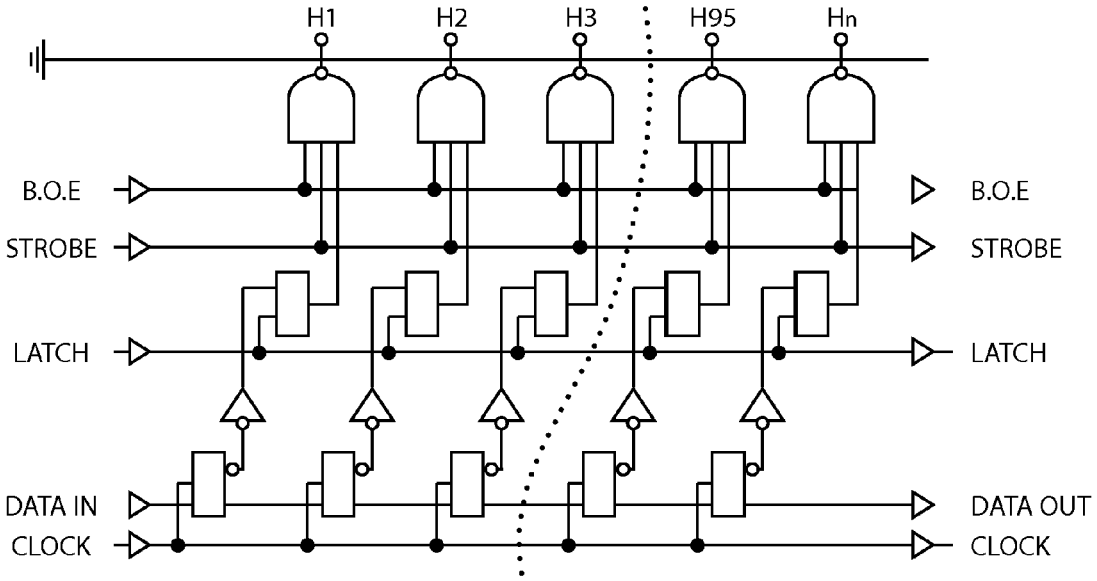
FIG. 1 is a circuit diagram that illustrates typical communicative parts in a thermal printing system.

These IC elements may be control by a plurality of control signals which, in turn, may fire a plurality of heaters. As illustrated in FIG. 1, a typical IC may control a plurality of heaters, labeled H1-Hn, where n may be 96 to 1984 or more heaters on printheads containing Dot History, connected to a common voltage. ICs may have differing requirements for the number of control signals needed, typically between four (4) and twelve (12) depending on the IC, by way of non-limiting example. As illustrated in FIG. 1, typical control signals may include a block enable out (BEO) pulse, a strobe pulse, a latch pulse, a clock pulse, and a data bit. Data bits may typically be presented as "high" for executing printing and "low" for not printing. For example, a printer controller may present a data bit on the DATA IN pin and pulse the clock pin. The data bit may then be copied into the leftmost shift register on the rising clock pulse—with any existing data shifting to the rightmost register. The IC may repeat this exercise a number of times equal to the number of heaters on the TPH, for example. A latch pulse may then cause the data bits to be copied to the latch registers to await the assertion of the strobe and BEO pins. Current will flow into heater elements having a high data bit in the respective latch register, for example, for as long as the strobe and BEO is high.

E type signaling DHC may include techniques for reducing pulse width when a heater element has retained heat from firing on a previous print line. A primary advantage to using DHC in a printer may be to improve the quality of printer during high speed operation. An additional advantage of DHC may be that without utilizing DHC, heaters running "hot" may need to be turned off to allow for temperature equalization with unfired heater elements in the same IC, for example. Without controlling the overall temperature of the heater elements through DHC, the heater elements may overheat during printing and may promote poor print quality by turning too much of the subject media dark causing a "smudging" effect, or by damaging or "burning out" the resistor heaters and a shortening of the over life of the IC or heater element. Further, the use of DHC may allow for greater energy efficiency, and may reduce the overall energy consumed during printing.

For K type DHC, the ICs may receive a strobe signal firing all selected heater elements for the same amount of time. Utilizing DHC, the printer controller may briefly fire the individual heater elements using a strobe pulse varied in width by printed dot. This function, which may be computed by the printer controller, may, for example, be implemented using five (5) additional control signals, which the printer controller holds low for progressively shorter amounts of time. The printer controller, or IC driver, may choose which controller signal pulse width to use for each printed dot based on at least one function of that dot's immediate state, the immediate states of adjacent dots and the previous states of the current and adjacent dots.

Figure 2:
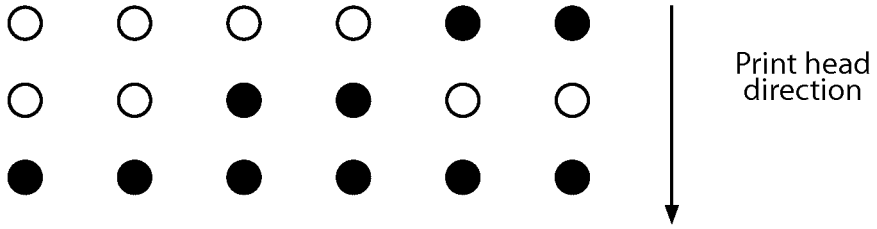
FIG. 2 is an illustration of typical pixel progression in thermal printing.

As illustrated in FIG. 2, seven (7) controller signals may be used for DHC within an IC. In accordance with the depicted printing direction, the lowermost circles are black to indicate that these heater elements have been selected to fire on that print line. The two circles above indicate whether or not the heater element fired in the at least two previous lines.

For example, "cont. 1" is relatively cold because it did not fire in the preceding two lines, while "cont. 5" is relatively hot because it did fire in the proceeding two lines. To print these two dots on the present print line with a substantially similar optical density, for example, the printer controller in combination with the driver ICs must hold "cont. 1" low for a longer time than "cont. 5". Thus, the IC may switch a heating element on as long as the appropriate controller signal is low, the strobe pulse is low, the BOE is high, and the data bit in the latch register is high. The selection of which of the "cont #" signals to use may be computed by the specific driver IC based on the temporal and spatial locality of hot and cold dots.

In an embodiment of the present invention, a conversion circuit is provided to allow a printer controller to send a different set of control signals for DHC to an IC than the IC is designed to receive and that the signaling type is automatically detected and converted. For example, a printer controller programmed to send seven (7) DHC controller signals may be interfaced with an IC designed to receive only five (5) DHC controller signals using a conversion circuit of the present invention. Similarly, to facilitate communication between a printer controller using five (5) DHC controller signals and an IC designed to receive seven (7) DHC controller signals, the conversion circuit example of the present invention may be employed. The DHC convertions/detection circuit may be built into the TPH, along with specific DHC driver ICs, such as to ensure the driver ICs receive the correct DHC signaling they were designed for regardless of which of any of several DHC signaling types the printer is designed to deliver.

Figure 3:
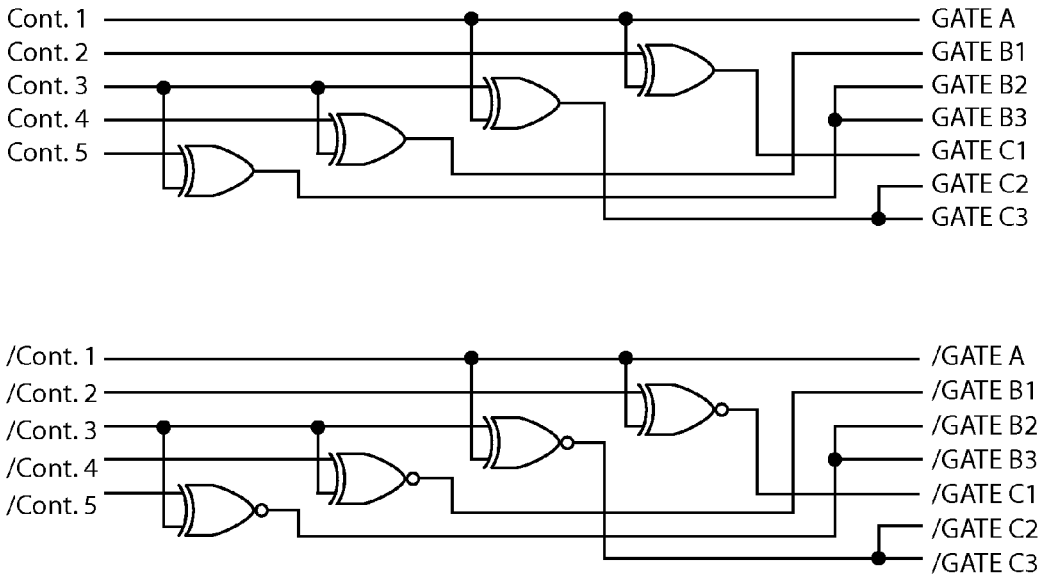
FIG. 3 is a circuit diagram that illustrates a portion of an integrated circuit driver which is used to convert signals in accordance with the present invention.

As illustrated in FIG. 3, a conversion circuit may allow for the input of five (5) controller signals, each of which may vary as to different lengths of heater "turn on" times (K type dot history), which may be converted into seven (7) controller signals. These seven (7) controller signal control the power to the heater by trimming or shortening a reference heater's "on time" (E type dot history).

Figure 4A:
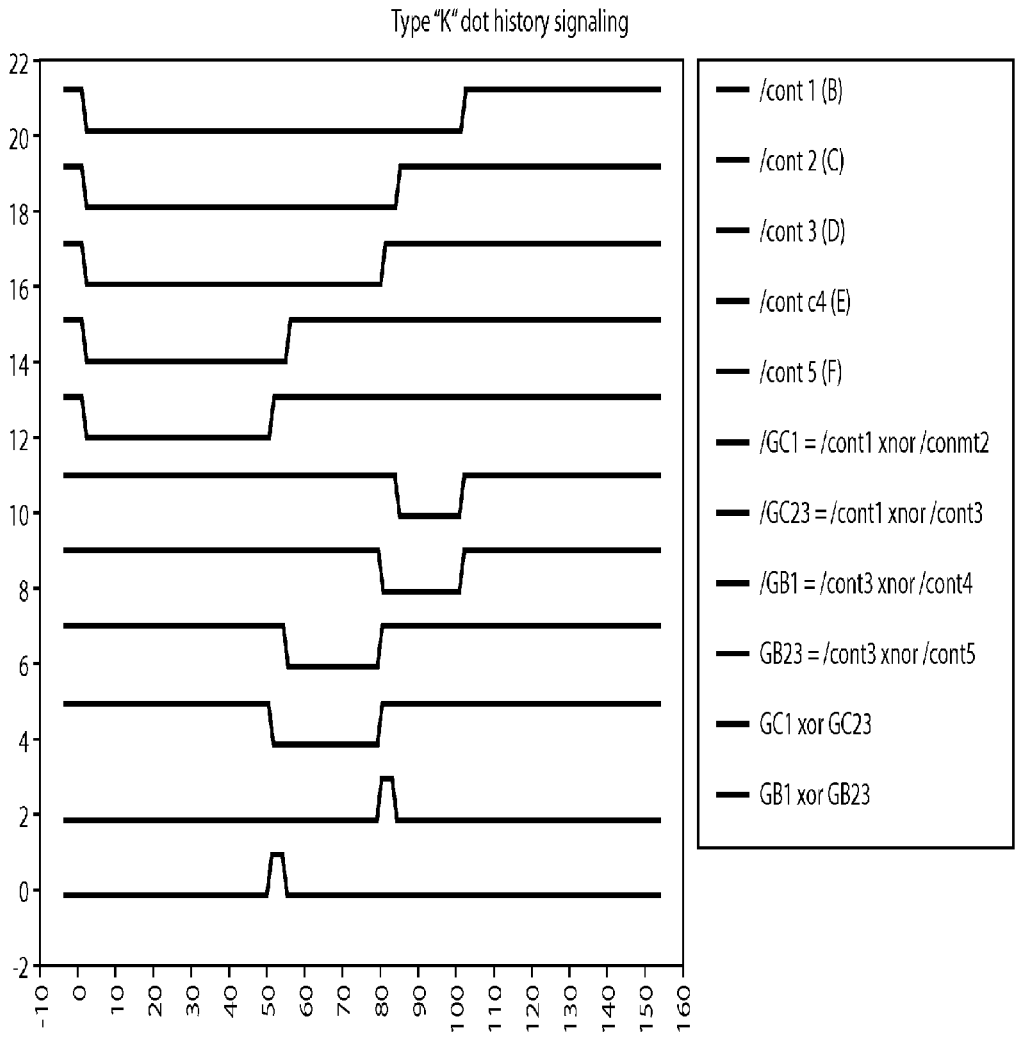
FIG. 4A is a signaling diagram that illustrates the signal timing of an originating and a converted thermal history control signal set ("K type" signaling) in accordance with the present invention.

FIG. 4A illustrates a timing chart further illustrating signals related to at least one signal combination for at least one line of dots in FIG. 2 utilizing the conversion circuit of the present invention. The timing chart of FIG. 4A illustrates five (5) input DHC signals (/cont1 to /cont5) having highs and lows and signal strength along with four (4) created trim signals (/GC1, /GC23, /GB1, /GB23). These trim signals, which are created by the exemplary circuit, may be expanded to seven signals (/GC23 is /GC2 and /GC3, etc.), such as to be used to control a driver IC intended for seven control signals. For example, Gates B2 and B3 may be controlled by XNOR function using signals from "cont. 3" and "cont, 5" in accordance with the signals and highs and lows associated with the input signals. Similarly, Gate C1 may be controlled by XNOR function using signals from "cont. 1" and "cont, 2" in accordance with the signal strength and highs and lows associated with the input signals. In the example, Gate A does not need signal conversion, as it is the same signal as /cont1.

Figure 4B:
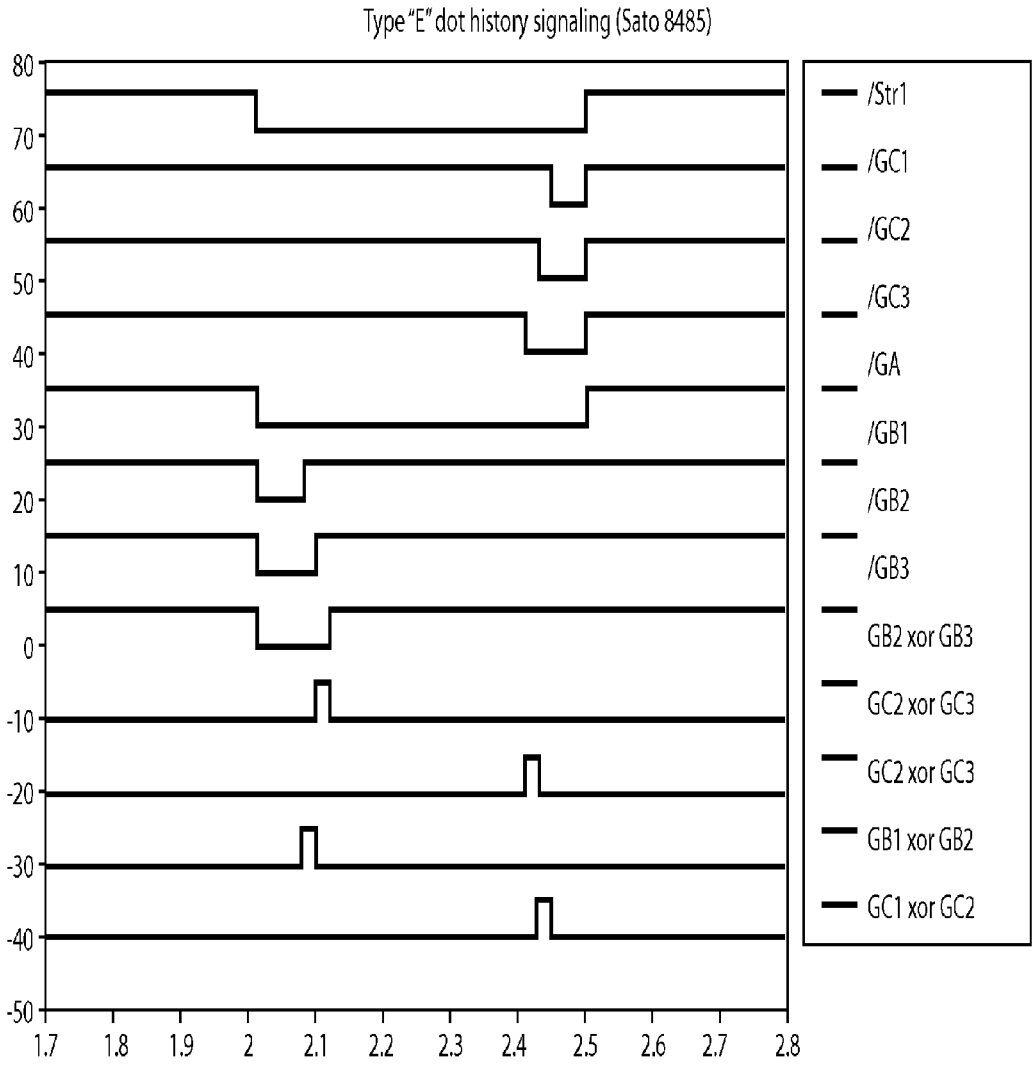
FIG. 4B is a signaling diagram that illustrates signal timing for thermal history control signals using strobe shortening "trim signals" ("E type" signaling) in accordance with the present invention.

The present invention may also be used with a conversion circuit which allows five (5) DHC signals from the printer intended to control ICs requiring seven (7) DHC signals (in addition to the standard control signals). As illustrated in FIG. 4B, the signaling associated with the conversion of seven (7) input DHC signals to five (5) control signals may include signals produced through at least four (4) XOR gates, for example.

The present invention allows for the automated selection of the appropriate conversion, per the discussion above, based on the specifics of received DHC signals. As discussed above, the most common number of DHC signals output by a printer's IC may be either five (5) or seven (7). By detecting the specifics of incoming signals and selecting the most suitable conversion, the present invention may provide for an adaptable replacement printhead compatible with several types of DHC signals from the printer.

Figure 5:
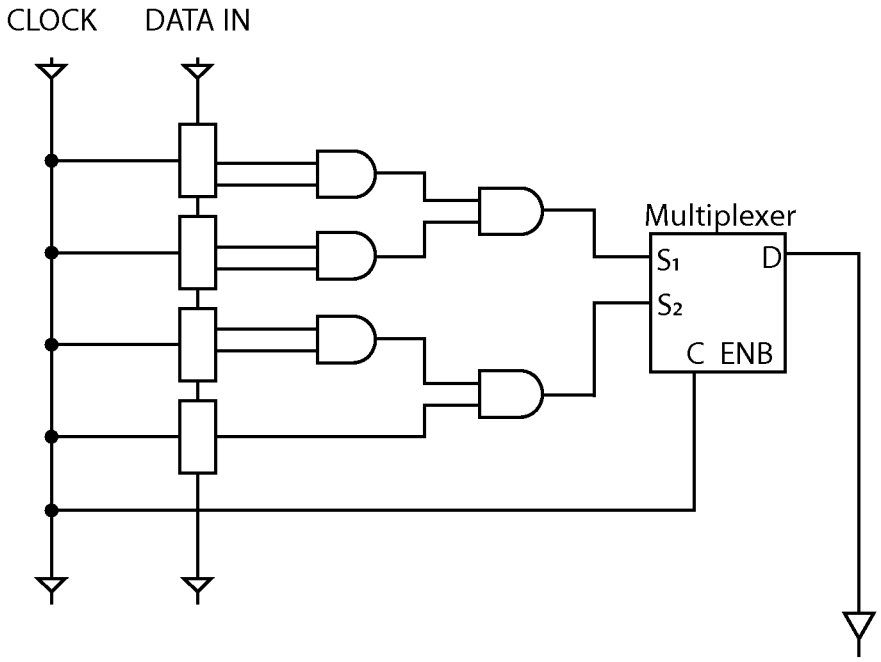
FIG. 5 illustrates an exemplary logic circuit.

As illustrated in FIG. 5, an exemplary array of any type of logic gates, such as AND gates, for example, may be used to determine if less than seven (7) DHC signals are being received by the printhead (K type signaling). The receiving of less than seven (7) received signals may be determined if the result through the array of gates is false. Thus, a false value, i.e., the absence of seven (7) signals, may indicate that five (5) DHC signals are in use. Conversely, a true result, i.e., the presence of seven (7) signals (E type signaling), may be indicative that seven (7) DHC signals are in use. Of course, alternatively a true value may be sought for five (5) signals, wherein a false value would indicate seven (7) DHC signals.

Exemplary signal detection that may be used with the present invention may include an arrangement of gates based on the assumption that any received DHC signals will either number five (5) or seven (7). Thus, the receiving of seven (7) DHC signals sent from a printer IC may be detected using a simple gate. For example, an AND gate may received both signals "cont. 6" and "cont. 7," and will therefore yield a true if seven (7) signals are sought.

Similarly, those skilled in the art will appreciate that alternative logic gates, accumulating logic, or the like may be used to assess the type of signaling expected for communication with the print head. By way of additional, non-limiting example, a multiplexer (MUX) may be used to accumulate incoming 1s and 0s, thereby outputting an indication of whether input was received on seven (7) or five (5) of 8 bit inputs.

To overcome any false positives related to the output provided by the IC, a specific test may be run on the printer upon insertion of a printhead comprising the present logic, to ensure proper detection of the number of received signals. For example, a test page may be printed maximum signaling to be generated by the IC by, for example, printing a series of printed shapes requiring the use of each heater element. By completing such an action, a newly engaged printhead may detect and select the use of a proper conversion as discussed above.

With or without a test as described, time buffering, such as shift registers, may be employed to improve detection results by buffering by a predetermined time, such as by three (3) print period intervals, for example, the providing of received DHC data for determination by the present invention of the number of signals being used by the printer. Shift registers or the like may be employed with any arrangement of gates to determine the number of received DHC signals.

By way of additional non-limiting example, certain print heads may provide an interface that can optionally be fitted to multiple different printers, some of which may have a dot history of Type A, and some may have a dot history of Type B. As used immediately hereinbelow, "Type A" is used to indicate a particular number of signals in a dot history, while "Type B" is used to indicate a different number of signals in a dot history. For example, Type A may indicate 5 signal signaling, and Type B may indicate 7 signal signaling, although the number of signals for Type A and Type B may differ from this example, such any number of signals between 3 and 20, by way of non-limiting example. Thus, the present invention may be provided as a print head that can identify whether the printer into which the print head is placed is a Type A or Type B printer, and the print head will accordingly adjust to use the correct type of signaling.

Figure 6:
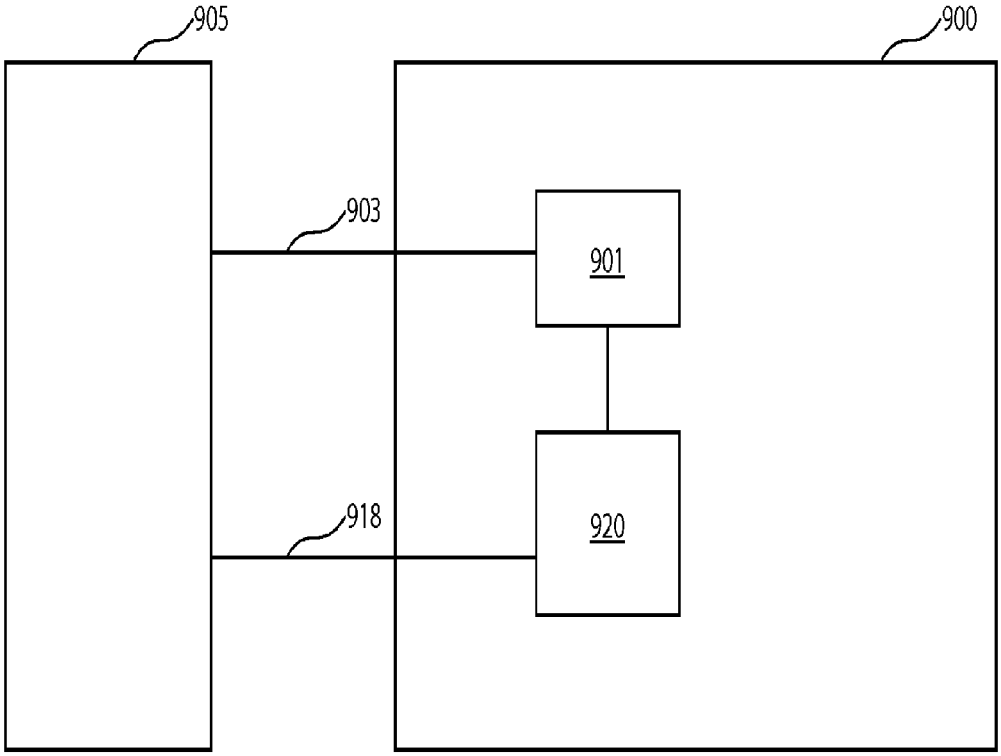
FIG. 6 is a schematic block diagram illustrating aspects of the present invention.

FIG. 6 is a schematic block diagram illustrating a system whereby a thermal print head is capable of sensing the signaling type of a printer into which the print head is placed, and is further capable of acting in the necessary manner in accordance with the sensed printer type. As illustrated, the print head 900 may include circuit 901, which may preferably include logic capable of sensing the number of incoming signals received or requested from or by input 903 from printer 905. Circuit 901 may, for example, sense signal transitions, i.e., high-low, or low-high, in order to assess the number of signals experiencing transitions, and hence the signaling type of the base printer 905. Alternatively, circuit 901 may simply sense the number of incoming signals, such as via current sensing, to obtain a signaling type of the base printer. Upon receive of these signals and/or signal requests at circuit 901, circuit 901 may indicate to the signal conversion circuit 920 discussed hereinthroughout, for example, a number of signals to be output 918 in accordance with the dot history type of the printer now physically associated with that print head. As such, circuit 901 may be in communication with the signaling conversion logic 920 discussed elsewhere herein, and signaling conversion logic may, correspondent to an instruction from circuit 901, output a number of signals in accordance with the correct type of dot history mandated for use with that base printer.

Although the invention has been described and pictured in an exemplary form with a certain degree of particularity, it is understood that the present disclosure of the exemplary form has been made by way of example, and that numerous changes in the details of construction and combination and arrangement of parts and steps may be made without departing from the spirit and scope of the invention; the conversion of one DHC scheme to another.

What is claimed is:

1. An automated signal detection system for use in a thermal print head, comprising:

a plurality of heating elements for applying a thermal printing by the thermal print head;

a plurality of first gating groups for receiving a type of control signals;

a receiving IC for receiving a type of converted control signals to control said plurality of heating elements;

a plurality of second gating groups capable of converting the type of the control signals to a first plurality of converted control signals;

a plurality of third gating groups capable of converting the type of the control signals to a second plurality of converted control signals;

at least one control switch capable of directing the type of control signals to one of said second gating groups and said third gating groups;

wherein said first gating groups are capable of determining a required type of said type of control signals, and wherein the determination actuates the at least one control switch.

2. The system of claim 1, wherein the plurality of second gating groups comprises at least one trimming circuit that effectuates the converting.

3. The system of claim 1, wherein the plurality of third gating groups comprises at least one trimming circuit that effectuates the converting.

4. The system of claim 1, wherein at least one of the plurality of first gating groups comprises an XOR gate.

5. The system of claim 1, wherein at least one of the plurality of first gating groups comprises an XNOR gate.

6. The system of claim 1, wherein at least one of the plurality of first gating groups comprises at least one multiplexer.

7. The system of claim 1, wherein a history of the first plurality of converted control signals or the second plurality of converted control signals determination tests is collected and stored in at least one shift register is communicatively connected to said first gating groups.

8. The system of claim 1, wherein at least one control switch is a multiplexer.

* * * * *